US007533539B2

(12) United States Patent
Otake et al.

(10) Patent No.: US 7,533,539 B2
(45) Date of Patent: May 19, 2009

(54) REFRIGERATING MACHINE

(75) Inventors: Masahisa Otake, Gunma (JP); Hiroshi Mukaiyama, Gunma (JP); Koji Sato, Gunma (JP); Kunie Sekigami, Gunma (JP); Kazuaki Shikichi, Tochigi (JP)

(73) Assignees: Sanyo Electric Co., Ltd., Osaka (JP); Sanyo Air-Conditioning Corporation, Gunma (JP)

( * ) Notice: Subject to any disclaimer, the term of this patent is extended or adjusted under 35 U.S.C. 154(b) by 546 days.

(21) Appl. No.: 11/151,297

(22) Filed: Jun. 14, 2005

(65) Prior Publication Data

US 2005/0279126 A1 Dec. 22, 2005

(30) Foreign Application Priority Data

Jun. 18, 2004 (JP) ..... P2004-180772

(51) Int. Cl.
*F25B 1/00* (2006.01)

(52) U.S. Cl. ..... 62/498

(58) Field of Classification Search ..... 62/498, 62/324.1, 513, 515, 524
See application file for complete search history.

(56) References Cited

U.S. PATENT DOCUMENTS

2004/0211216 A1* 10/2004 Yamasaki et al. ..... 62/498

FOREIGN PATENT DOCUMENTS

JP 2804527 3/1991

* cited by examiner

*Primary Examiner*—Melvin Jones
(74) *Attorney, Agent, or Firm*—McDermott Will & Emery LLP

(57) ABSTRACT

A refrigerating machine equipped with a compressor has an intermediate-pressure portion in which refrigerant having intermediate pressure higher than the pressure of the refrigerant at the suction side of the compressor and lower than the pressure of the refrigerant at the discharge side of the compressor is allowed to be introduced, and a heat exchange circuit formed between a heat-source side heat exchanger and a using side heat exchanger. The heat exchange circuit branches the refrigerant flowing from any one of the heat exchangers to the other heat exchanger, carries out heat exchange between one branched refrigerant and the other branched refrigerant or the refrigerant before the branching so that the one branched refrigerant is set to gas-phase refrigerant, and the gas-phase refrigerant thus achieved is led to any one of the intermediate-pressure portion and refrigerant suction pipe of the compressor.

7 Claims, 6 Drawing Sheets

REFRIGERATING MACHINE

BACKGROUND OF THE INVENTION

1. Field of the Invention

The present invention relates to a refrigerating machine that has an outdoor unit and a plurality of indoor units and enables these plural indoor units to carry out heating operation and cooling operation in a mixing style.

2. Description of the Related Art

There is generally known a refrigerating machine in which an outdoor unit is connected to a plurality of indoor units through an inter-unit pipe comprising a high-pressure gas pipe, a low-pressure gas pipe and a liquid pipe so that one of cooling operation and heating operation can be carried out in the plural indoor units at the same time or both cooling operation and heating operation can be carried out in the plural indoor units in a mixing style at the same time (see Japanese Patent No. 2804527). In this specification, it is assumed that the refrigerating machine contains a heat pump.

This type of refrigerating machine has a problem that when the temperature of refrigerant at the exit of a heat exchanger used as a radiator (hereinafter referred to as "radiation side heat exchanger") increases, the specific enthalpy of the refrigerant at the exist of the radiation side heat exchanger increases, and thus the wetness degree of refrigerant at the entrance of a heat exchanger used as an evaporator (hereinafter referred to as "evaporation side heat exchanger") is reduced, so that the performance of the refrigerating machine is lowered.

SUMMARY OF THE INVENTION

Therefore, an object of the present invention is to provide a refrigerating machine which can keep or enhance the performance thereof even when the temperature of refrigerant at the exit of a radiation side heat exchanger increases, for example, when the outside temperature is high or the like.

In order to attain the above object, a refrigerating machine equipped with an outdoor unit containing a compressor and an outdoor heat exchanger serving as a heat-source side heat exchanger, a plurality of indoor units each of which contains an indoor heat exchanger as a using side heat exchanger and is connected to the outdoor unit through an inter-unit pipe, one end of the outdoor heat exchanger being selectively connected to any one of a refrigerant discharge pipe and a refrigerant suction pipe of the compressor, the inter-unit pipe comprising a high-pressure pipe connected to the refrigerant discharge pipe, a low-pressure pipe connected to the refrigerant suction pipe and a low-temperature high-pressure pipe connected to the other end of the outdoor heat exchanger, and one end of the indoor heat exchanger of each of the indoor units being selectively connected to any one of the high-pressure pipe and the low-pressure pipe while the other end of the indoor heat exchanger concerned is connected to the low-temperature high-pressure pipe, whereby the plural indoor units carry out any one of cooling operation and heating operation at the same time or carry out both cooling operation and heating operation in mixture at the same time, is characterized in that the compressor has an intermediate-pressure portion in which refrigerant having intermediate pressure higher than the pressure of the refrigerant at the suction side of the compressor and lower than the pressure of the refrigerant at the discharge side of the compressor is allowed to be introduced, and the refrigerating machine is further provided with a heat exchange circuit formed in the low-temperature high-pressure pipe between the heat-source side heat exchanger and the using side heat exchanger, wherein the heat exchange circuit branches the refrigerant flowing from any one of the heat source-side heat exchanger and the using side heat exchanger to the other heat exchanger, carries out heat exchange between one branched refrigerant after the branching and any one of the other branched refrigerant after the branching and the refrigerant before the branching so that the one branched refrigerant is set to gas-phase refrigerant, and leads the gas-phase refrigerant thus achieved to any one of the intermediate-pressure portion and refrigerant suction pipe of the compressor.

According to the refrigerating machine of the present invention, the heat exchange circuit branches the refrigerant flowing from any one of the heat-source side heat exchanger and the using side heat exchanger to the other heat exchanger, carries out the heat exchange between one branched refrigerant after the branching and any one of the other branched refrigerant after the branching and the refrigerant before the branching so that the one branched refrigerant is set to gas-phase refrigerant, and leads the gas-phase refrigerant thus achieved to any one of the intermediate-pressure portion and refrigerant suction pipe of the compressor.

In the above refrigerant machine, the heat exchange circuit may be provided with a pressure reducing device for expanding the one branched refrigerant before the one branched refrigerant is heat-exchanged.

In the above refrigerating machine, the pressure reducing device may have an expansion valve, and the opening degree of the expansion valve may be adjusted on the basis of any one of the temperature at the exit of the expansion valve and the temperature at the exit of the other branched refrigerant side after the branching in the heat exchange circuit.

In the above refrigerating machine, the heat exchange circuit may have two refrigerant pipe systems, the one branched refrigerant flowing through one of the two refrigerant pipe systems while the other branched refrigerant flows through the other refrigerant pipe system, and the refrigerant pipe systems may be arranged so that the one branched refrigerant and the other branched refrigerant counter-flow in the opposite direction.

In the above refrigerating machine, the refrigerant pipe systems may be arranged so that the one branched refrigerant and the other branched refrigerant counter-flow in the opposite direction at least under cooling operation.

In the above refrigerating machine, the inside of the high-pressure pipe connected to the refrigerant discharge pipe may be driven under supercritical pressure while the refrigerating machine is operated.

In the above refrigerating machine, carbon dioxide refrigerant may be filled as the refrigerant in a refrigerant pipe.

DETAILED DESCRIPTION OF THE PREFERRED EMBODIMENTS

Preferred embodiments according to the present invention will be described with reference to the accompanying drawings.

[1] First Embodiment

Figure 1:
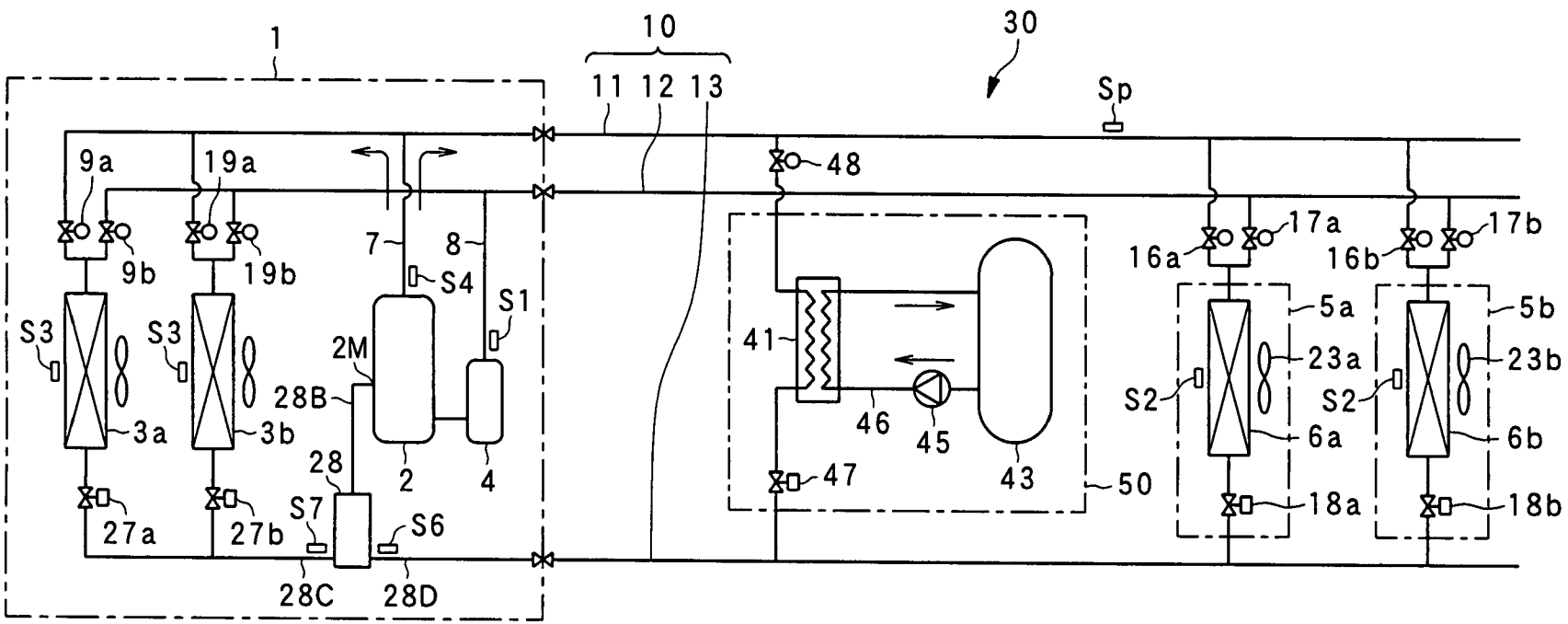
FIG. 1 is a diagram showing a refrigerant circuit of a refrigerating machine according to a first embodiment.

FIG. 1 is a refrigerant circuit diagram showing an embodiment of a refrigerating machine according to the present invention.

A refrigerating machine 30 is equipped with an outdoor unit 1 having a compressor 2, outdoor heat exchangers 3*a*, 3*b* and outdoor expansion valves 27*a*, 27*b*, an indoor unit 5*a* having an indoor heat exchanger 6*a* and an indoor expansion valve 18*a*, an indoor unit 5*b* having an indoor heat exchanger 6*b* and an indoor expansion valve 18*b*, and a hot-water stocking unit 50 having a hot-water stocking heat exchanger 41, a hot-water stocking tank 43, a circulating pump 45 and an expansion valve 47.

The outdoor unit 1, the indoor units 5*a*, 5*b* and the hot-water stocking unit 50 are connected to one another through an inter-unit pipe 10, and the refrigerating machine 30 can carry out cooling operation or heating operation in the indoor units 5*a*, 5*b* at the same time or carry out both cooling operation and heating operation in the indoor units 5*a*, 5*b* in a mixing style at the same time while the hot-water stocking unit 50 is operated.

In the outdoor unit 1, one end of the outdoor heat exchanger 3*a* is exclusively connected to the discharge pipe 7 or suction pipe 8 of the compressor 2 through a change-over valve 9*a* or a change-over valve 9*b*. Likewise, one end of the outdoor heat exchanger 3*b* is exclusively connected to the discharge pipe 7 or suction pipe 8 of the compressor 2 through a change-over valve 19*a* or 19*b*. An accumulator 4 is disposed in the suction pipe 8.

The outdoor unit 1 is equipped with an outdoor control device (not shown), and the outdoor control device controls the compressor 2, the outdoor expansion valves 27*a*, 27*b* and the change-over valves 9*a*, 19*a*, 9*b*, 19*b* in the outdoor unit 1 and the whole of the refrigerating machine 30.

Furthermore, the refrigerating machine 30 is equipped with a temperature sensor S1 for detecting the refrigerant temperature at the entrance of the accumulator 4, a temperature sensor S2 for detecting the refrigerant temperature of the indoor heat exchanger 6*a*, 6*b*, a temperature sensor S3 for detecting the refrigerant temperature of the outdoor heat exchanger 3*a*, 3*b*, a temperature sensor S4 for detecting the refrigerant temperature at the exit of the compressor 2, a pressure sensor Sp for detecting the high-pressure side pressure corresponding to the refrigerant pressure in the high-pressure pipe 11, and a temperature sensor S5 for detecting the refrigerant temperature of the intermediate-pressure portion (the exit of the heat exchange expansion valve 28F).

Figure 2:
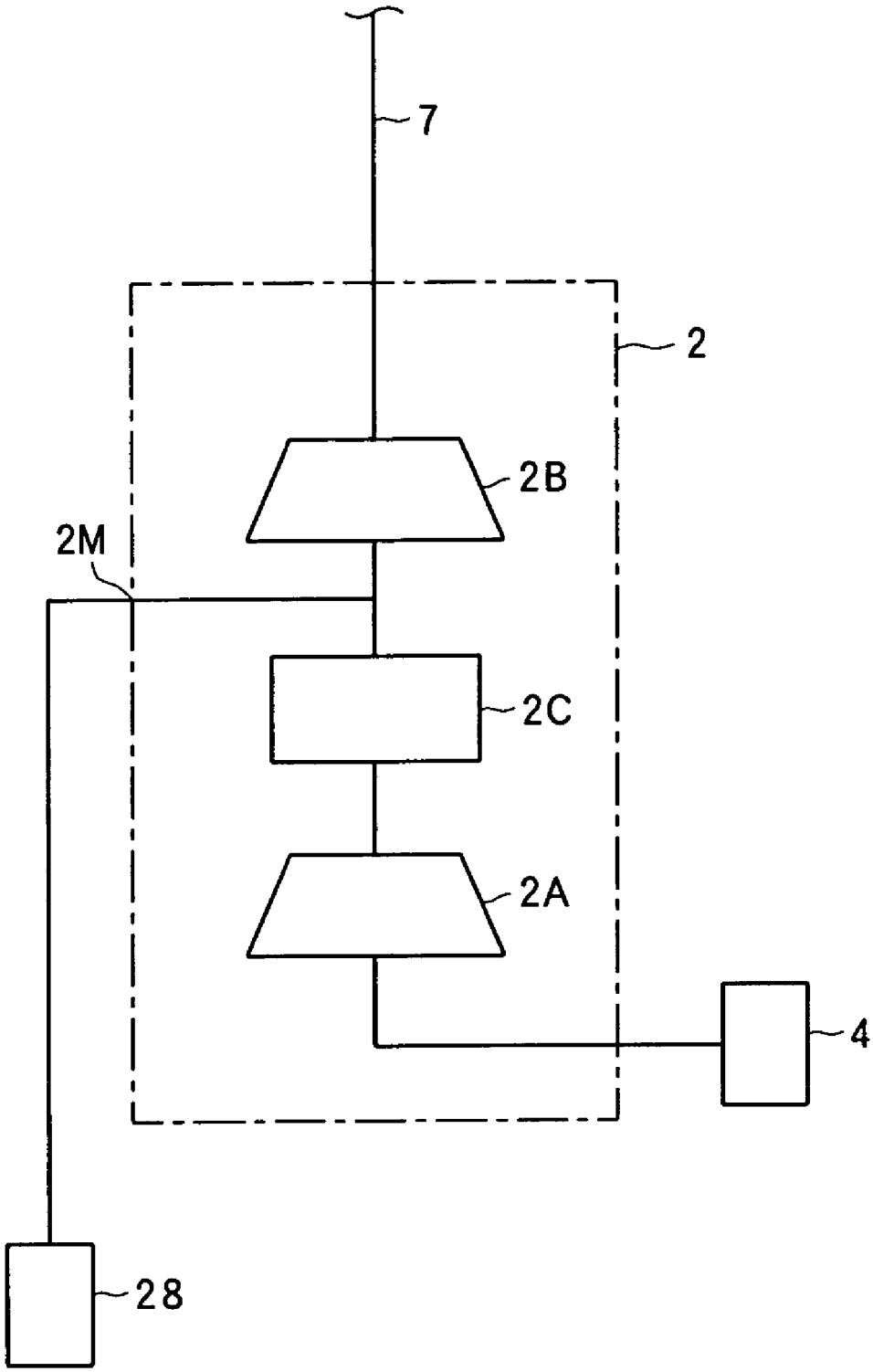
FIG. 2 is a block diagram showing the construction of a compressor.

FIG. 2 is a block diagram showing the construction of the compressor.

The compressor 2 is a two-stage compressor, and it comprise a first-stage compressing unit 2A for compressing refrigerant at the low-pressure suction side, a second-stage compressing unit 2B for compressing refrigerant at the high-pressure discharge side, and an intermediate cooler 2C for cooling the refrigerant discharged from the first-stage compressing unit 2A and outputting the refrigerant thus cooled to the second-stage compressing unit 2B side. An intermediate pressure portion which can introduce refrigerant from the external is provided at the intermediate portion between the second-stage compressing unit (high-pressure discharge side) 2B and the intermediate cooler 2C.

The inter-unit pipe 10 is equipped with a high-pressure pipe (high-pressure gas pipe) 11, a low-pressure pipe (low-pressure gas pipe) 12 and a low temperature high-pressure pipe (liquid pipe) 13. The high-pressure pipe 11 is connected to the discharge pipe 7, and the low-pressure pipe 12 is connected to the suction pipe 8. The low temperature high-pressure pipe 13 is connected through the outdoor expansion valves 27*a*, 27*b* to the other ends of the outdoor heat exchangers 3*a*, 3*b*.

A heat exchange circuit (gas-liquid separator) 28 is connected between the low-temperature high-pressure pipe 13 and the outdoor expansion valve 27*a*, 27*b*, and the gas outlet pipe 28B of the heat exchange circuit 28 is connected to the intermediate-pressure portion 2M of the compressor 2 so that the gas-phase refrigerant is mainly introduced from the gas outlet pipe 28B into the compressor 2. The heat exchange circuit 28 is constructed as a bi-directional type gas-liquid separating device into which the refrigerant can flow from both the outdoor heat exchanger 3*a*, 3*b* side and the indoor heat exchanger 6*a*, 6*b* side.

Figure 3:
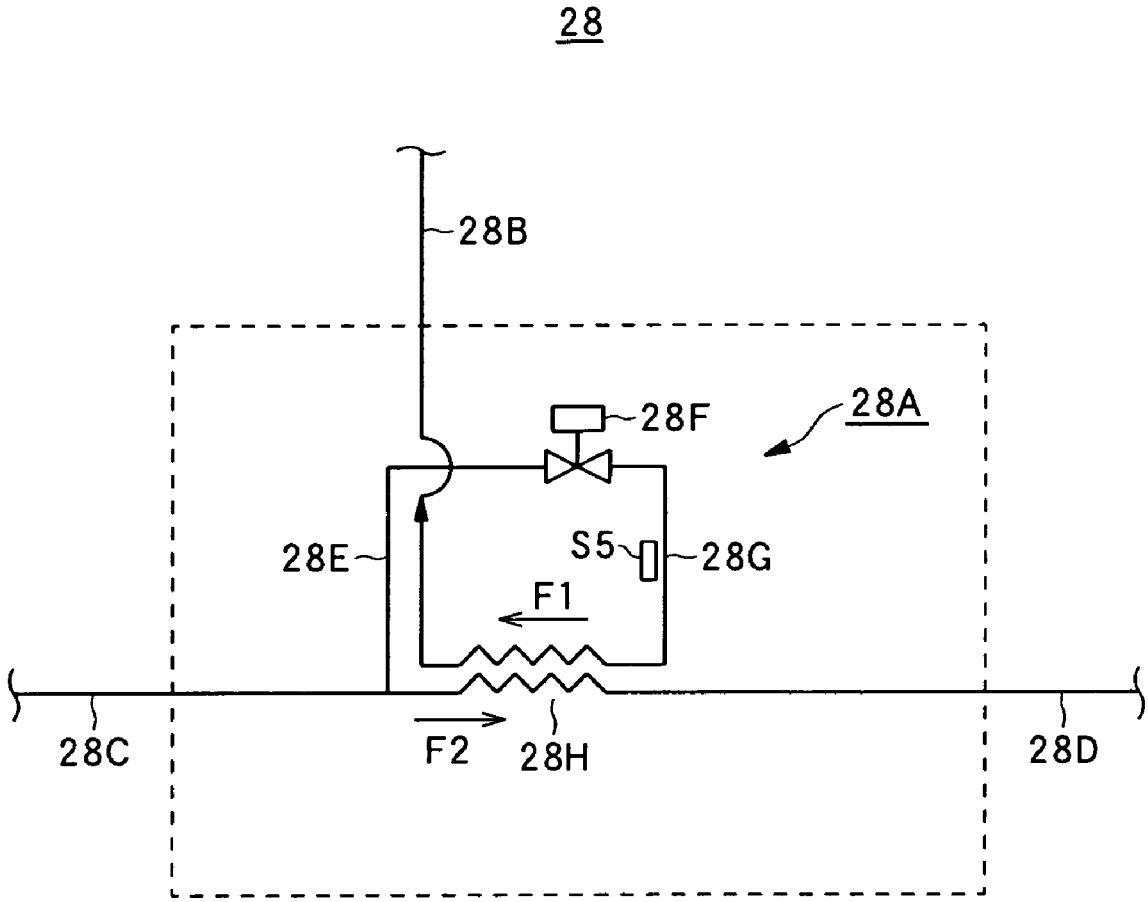
FIG. 3 is diagram showing the construction of a heat exchange circuit of the compressor.

FIG. 3 is a diagram showing the construction of the heat exchange circuit according to the first embodiment.

Here, the specific construction of the heat exchange circuit 28 will be described.

The heat exchange circuit 28 mainly comprises a heat exchange portion 28A, the gas outlet pipe 28B, a first inlet/outlet pipe 28C and a second inlet/outlet pipe 28D.

The heat exchange portion 28A comprises a branch pipe 28E branched from the first inlet/outlet pipe 28C, a heat exchange expansion valve 28F connected to the branch pipe 28E, a first heat exchange portion 28G that is connected to the heat exchange expansion valve 28F at one end thereof and intercommunicates with the gas outlet pipe 28B at the other end thereof to carry out actual heat exchange, and a second heat exchange portion 28H that is branched from the first inlet/outlet pipe 28C and intercommunicates with the second inlet/outlet pipe 28D to carry out heat exchange with the first heat exchange portion 28G.

In this case, the pipes constituting the first heat exchange portion 28G and the second heat exchange portion 28H are arranged so that the flow Fl of the refrigerant in the first heat exchange portion 28G and the flow F2 of the refrigerant in the second heat exchange portion 28H are opposite to each other, that is, the refrigerant in the first heat exchange portion 28G and the refrigerant in the second heat exchange portion 28H counter-flow in the opposite directions under cooling operation as shown in FIG. 3.

Furthermore, in accordance with the flow direction of the refrigerant in the low-temperature high-pressure pipe 13, one of the first inlet/outlet pipe 28C and the second inlet-outlet pipe 28D functions as an inlet pipe into which high-pressure refrigerant flows, and the other inlet/outlet pipe functions as a liquid outlet pipe from which the cooled refrigerant after gas-liquid separation flows out.

One ends of the indoor heat exchangers 6*a*, 6*b* of the indoor units 5*a*, 5*b* are connected to the high-pressure pipe 11 through the discharge side valves 16*a*, 16*b*, and also connected to the low-pressure pipe 12 through the suction side valves 17*a*, 17*b*. The other ends of the indoor heat exchangers 6*a*, 6*b* are connected to the low-temperature high-pressure pipe 13 through the indoor expansion valves 18*a*, 18*b*.

When one of the discharge side valve 16*a* and the suction side valve 17*a* is opened, the other valve is closed. Likewise, when one of the discharge valve 16*b* and the suction side valve 17*b* is opened, the other valve is closed. Accordingly, one end of each indoor heat exchanger 6*a*, 6*b* is selectively connected to one of the high-pressure pipe 11 and the low-pressure pipe 12 of the inter-unit pipe 10.

Each of the indoor units 5*a*, 5*b* is further equipped with an indoor fan 23*a* (23*b*), a remote controller and an indoor control device. The respective indoor fans 23*a*, 23*b* are disposed in proximity to the indoor heat exchangers 6*a*, 6*b* to blow air to the indoor heat exchangers 6*a*, 6*b*, respectively. Furthermore, each remote controller is connected to each of the indoor unit 5*a*, 5*b*, and outputs an instruction for cooling or heating operation, a stop instruction, etc. to the indoor control device of each indoor unit 5*a*, 5*b*.

In the hot-water stocking unit 50, one end of the hot-water stocking heat exchanger 41 is connected through a switching valve 48 to the high-pressure pipe 11, and the other end of the hot-water stocking heat exchanger 41 is connected through the expansion valve 47 to the. low-temperature high-pressure pipe 13. A water pipe 46 is connected to the hot-water stocking heat exchanger 41, and a hot-water stocking tank 43 is connected through a circulating pump 45 to the water pipe 46.

In this embodiment, carbon dioxide refrigerant is sealingly filled in the outdoor unit 1, the pipes in the indoor units 5*a*, 5*b* and the hot-water stocking unit 50 and the inter-unit pipe 10.

Figure 4:
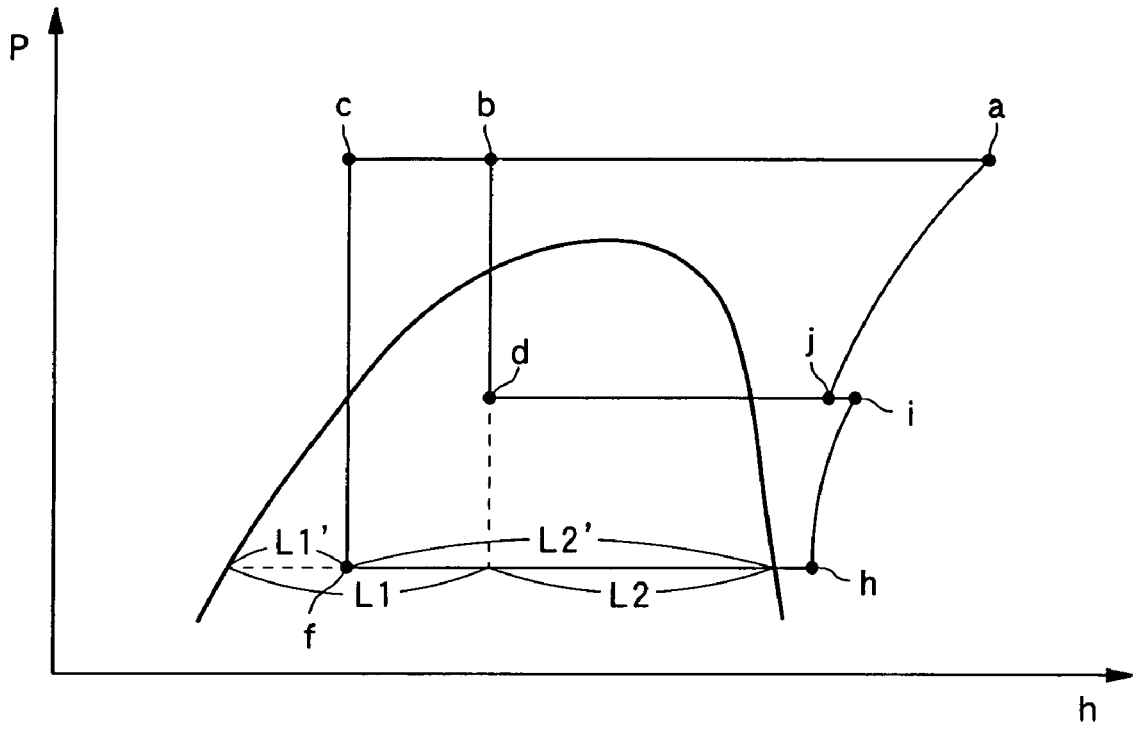
FIG. 4 is a pressure-enthalpy chart of the embodiment.

FIG. 4 is a pressure-enthalpy chart of the refrigerating machine thus constructed.

When carbon dioxide refrigerant is filled, the inside of the high-pressure pipe 11 is operated under supercritical pressure while the refrigerating machine is operated. Not only carbon dioxide refrigerant, but also ethylene, diborane, ethane, nitrogen oxide or the like may be used as the refrigerant with which the inside of the high-pressure pipe 11 is operated under supercritical pressure, for example.

In FIG. 4, the state of the refrigerant at the exit of the compressor 2 is represented by a state a. The refrigerant is passed through the heat exchangers and circulated in the refrigerant circuit, and cooled until the state a is shifted to a state b, thereby radiating heat to cooling air. Then, the refrigerant thus cooled is branched in the heat exchange circuit 28, and one branched refrigerant is passed through the heat exchange expansion valve 28F while reduced in pressure and thus expanded by the heat exchange expansion valve 28F, and thus the state b of the refrigerant concerned is shifted to a state d which corresponds to a two-phase mixed state of gas-phase and liquid-phase. The refrigerant under the two-phase mixed state d in the first heat exchange portion 28G is heat-exchanged with the refrigerant in the second heat exchange portion 28H and evaporated. As a result, a part of the high-pressure single-phase refrigerant which flows into the heat exchange circuit 28 is separated as gas-phase refrigerant, and returned to the intermediate-pressure portion 2M of the compressor 2. A state j corresponds to a state at the entrance of the second-stage compressing portion 2B of the compressor 2.

The other branched refrigerant after the refrigerant is branched is cooled in the heat exchange circuit 28, and its state b is shifted to a state c. Then, the refrigerant under the state c is reduced in pressure by the expansion valves serving as pressure-reducing devices, and thus its state c is shifted to a state f. Then, the refrigerant enters the evaporators and it is evaporated while absorbing heat. Here, a state h is a state at the exit of the evaporators, that is, at the entrance of the first-stage compressing portion 2A of the compressor 2, and a state i is a state at the exit of the first-stage compressing portion 2A of the compressor 2.

In the supercritical cycle, the high-pressure gas-phase refrigerant discharged from the compressor 2 is not condensed, but it is reduced in temperature in the heat exchangers. The high-pressure gas-phase refrigerant is cooled till the state b under which the temperature of the refrigerant is higher than the temperature of the cooling air by several degrees.

Next, the operation of the refrigerating machine 30 will be described.

Cooling Operation

First, the operation of the refrigerating machine under cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

In this case, the outdoor expansion valves 27*a*, 27*b* are fully opened so that the refrigerant is not reduced in pressure, and the opening degrees of the indoor expansion values 18*a*, 18*b* are controlled so that the difference between the detection temperature of the temperature sensor S1 and the detection temperature of the temperature sensor S2 (corresponding to the superheat degree) is equal to a fixed value and the high-pressure side pressure detected by the pressure sensor Sp is equal to a predetermined value, and the expansion valve 28F of the heat exchange circuit 28 is controlled so that the temperature of the refrigerant at the exit of the heat exchange expansion valve of the heat exchange expansion valve 28F which is detected by the temperature sensor S5 is equal to a predetermined value.

When the compressor 2 is driven, the refrigerant discharged from the compressor 2 successively flows through the discharge pipe 7, the change-over valves 9*a*, 19*a* and the outdoor heat exchangers 3*a*, 3*b* in this order.

After the refrigerant is heat-exchanged in the outdoor heat exchangers 3*a*, 3*b*, it is not reduced in pressure in the outdoor expansion valves 27*a*, 27*b*, and reaches the first inlet/outlet pipe 28C (functioning as the inlet pipe) of the heat exchange circuit 28.

The liquid refrigerant reaching the first inlet/outlet pipe 28C of the heat exchange circuit 28 is branched in the heat exchange circuit 28, and a part of the refrigerant flows to the branch pipe 28E while the other part of the refrigerant flows to the second heat exchange portion 28H. The liquid refrigerant flowing into the branch pipe 28E is reduced in pressure by the heat exchange expansion valve 28F and then reaches the first heat exchange portion 28G.

As a result, the heat exchange is carried out between the first heat exchange portion 28G and the second heat exchange portion 28H, and the first heat exchange portion 28G functions as an evaporator. The gas-liquid mixed refrigerant in the first heat exchange portion 28G becomes substantially gas-phase refrigerant, and it is supplied through the gas outlet pipe 28B to the intermediate-pressure portion 2M of the compressor 2 and compressed in the compressor 2.

Furthermore, the liquid-phase refrigerant flowing in the second heat exchange portion 28H flows through the second inlet/outlet pipe 28D into the low-temperature high-pressure pipe 13, and it is distributed to the indoor expansion valves 18*a*, 18*b* of the indoor units 5*a*, 5*b* and reduced in pressure there.

Thereafter, the refrigerant is evaporated in the indoor heat exchangers 6*a*, 6*b*, and then flows to the suction side valves 17*a*, 17*b*. Thereafter, the refrigerant is successively passed through the low-pressure pipe 12, the suction pipe 8 and the accumulator 4 in this order, and sucked into the compressor 2.

As described above, all the indoor units 5*a*, 5*b* carry out cooling operation at the same time by the action of each of the indoor heat exchangers 6*a*, 6*b* serving as evaporators.

Heating Operation

Next, the operation of the refrigerating machine under heating operation will be described.

When the indoor units 5*a*, 5*b* carry out heating operation, the change-over valves 9*a*,19*a* of the outdoor heat exchangers 3*a*, 3*b* are closed and also the other change-over valves 9*b*, 19*b* are opened. In addition, the discharge side valves 16*a*, 16*b* are opened, and the suction side valves 17*a*, 17*b* are closed.

In this case, the indoor expansion valves 18*a*, 18*b* are fully opened so that the refrigerant is not reduced in pressure, and the opening degrees of the outdoor expansion valves 27*a*, 27*b* are controlled so that the difference between the detection temperature of the temperature sensor S1 and the detection temperature of the temperature sensor S3 (corresponding to the superheat degree) and the high-pressure side pressure detected by the pressure sensor Sp are equal to predetermined values.

Accordingly, the refrigerant discharged from the compressor 2 successively passes through the discharge pipe 7 and the high-pressure pipe 11 and then flows to the discharge side valves 16*a*, 16*b* and the indoor heat exchangers 6*a*, 6*b*. The refrigerant is heat-exchanged there without being condensed, and it is not reduced in pressure by the indoor expansion valves 18*a*, 18*b*. Furthermore, the refrigerant reaches the second inlet/outlet pipe 28D (functioning as the inlet pipe) of the heat exchange circuit through the low-temperature high-pressure pipe 13, and flows into the second heat exchange portion 28H. A part of the refrigerant flowing into the second heat exchange portion 28H is branched to the branch pipe 28E.

The liquid refrigerant flowing into the branch pipe 28E is reduced in pressure by the heat exchange expansion valve 28F, and reaches the first heat exchange portion 28G.

As a result, the heat exchange is carried out between the first heat exchange portion 28G and the second heat exchange portion 28H, and the first heat exchange portion 28G functions as an evaporator. The gas-liquid mixed refrigerant in the first heat exchange portion 28G becomes substantially gas-phase refrigerant, and it is supplied to the intermediate-pressure portion 2M of the compressor 2 through the gas outlet pipe 28B and compressed by the compressor 2.

Furthermore, the liquid-phase refrigerant flowing in the second heat exchange portion 28H is distributed to the outdoor expansion valves 27*a*, 27*b* of the outdoor units 3*a*, 3*b* through the first inlet/outlet pipe 28C (functioning as a liquid outlet pipe), and reduced in pressure there.

Thereafter, the liquid-phase refrigerant is evaporated in the outdoor heat exchangers 3*a*, 3*b*, flows through the discharge side valves 9*b*, 19*b*, and successively passes through the low-pressure pipe 12, the suction pipe 8 and the accumulator 4 in this order. Finally, the refrigerant thus evaporated is sucked into the compressor 2.

As described above, all the indoor units 5*a*, 5*b* carry out heating operation at the same time by the non-condensing heat exchange action of the indoor heat exchangers 6*a*, 6*b*.

Cooling and Heating Mixed Operation

Next, the operation of the refrigerating machine under cooling and heating mixed operation will be described.

When the indoor unit 5*a* carries out heating operation, the indoor unit 5*b* carries out cooling operation and the heating load is larger than the cooling load, the change-over valves 9*a*, 19*a* of the outdoor heat exchangers 3 are closed while the other change-over valves 9*b*, 19*b* are opened. Furthermore, the discharge side valve 16*b* corresponding to the indoor unit 5*b* carrying out the cooling operation is closed while the suction side valve 17*b* is opened, and also the discharge side valve 16*a* corresponding to the indoor unit 5*a* carrying out the heating operation is opened while the suction side valve 17*a* is closed. At this time, the refrigerant discharged from the compressor 2 is successively passed through the discharge pipe 7 and the high-pressure pipe 11, and distributed to the discharge side valve 16*a*. In the indoor heat exchanger 6*a*, the refrigerant is heat-exchanged without being condensed. The refrigerant thus heat-exchanged is passed through the fully-opened indoor expansion valve 18*a* without being reduced in pressure, and flows to the low-temperature high-pressure pipe 13. A part of the liquid refrigerant in the liquid pipe is reduced in pressure by the indoor expansion valve 18*b*, and then evaporated in the indoor heat exchanger 6*b*. The refrigerant thus evaporated flows to the suction side valve 17*b*, and it is successively passed through the low-pressure pipe 12, the suction pipe 8 and the accumulator 4 and then sucked into the compressor 2. The residual liquid refrigerant reaches the second inlet/outlet pipe 28*d* (functioning as an inlet pipe) of the heat exchange circuit 28 and flows to the second heat exchange portion 28H, and a part of the refrigerant concerned flows to the branch pipe 28E. The liquid refrigerant flowing into the branch pipe 28E is reduced in pressure by the heat exchange expansion valve 28F, and reaches the first heat exchange portion 28G.

As a result, the heat exchange is carried out between the first heat exchange portion 28G and the second heat exchange portion 28H, and the first heat exchange portion 28G functions as an evaporator. The gas-liquid mixed refrigerant in the first heat exchanger 28G becomes substantially gas-phase refrigerant, and it is supplied to the intermediate pressure portion 2M of the compressor 2 through the gas outlet pipe 28B and compressed in the compressor 2.

Furthermore, the liquid-phase refrigerant is reduced in pressure by the outdoor expansion valves 27*a*, 27*b* through the first inlet/outlet pipe 28C (functioning as a liquid outlet pipe), heat-exchanged in the outdoor heat exchangers 3*a*, 3*b* and flows to the suction side valves 9*b*, 19*b*. Therefore, the refrigerant is successively passed through the low-pressure pipe 12, the suction pipe 8 and the accumulator 4, and then sucked into the compressor 2.

As described above, the indoor unit Sa carries out the heating operation by the non-condensing heat-exchange action of the indoor heat exchanger 6*a*, and the indoor unit 5*b* carries out the cooling operation by the action of the indoor heat exchanger 6*b* serving as the evaporator.

Cooling+Hot-water Stocking Operation (part 1)

Next, a first operation of the refrigerating machine under (cooling+hot-water stocking) operation will be described.

In the case of the (cooling+hot-water stocking) operation, the change-over valves 9*a*, 19*a* of the outdoor heat exchangers 3*a*, 3*b* are opened and the other change-over valves 9*b*, 19*b* are closed. In addition, the discharge side valves 16*a*, 16*b* are closed, and the suction side valves 17*a*, 17*b* are opened. The outdoor fans 29*a*, 29*b* and the indoor fans 23*a*, 23*b* are set to the driving state, and the circulating pump 45 is set to the driving state. Furthermore, the switching valve 48 for connecting the high-pressure pipe 11 and the hot-water stocking heat exchanger 41 is opened.

In this case, the outdoor expansion valves 27*a*, 27*b* are fully opened so that the refrigerant is not reduced in pressure, and the opening degrees of the indoor expansion valves 18*a*, 18*b* are controlled so that the high-pressure side pressure detected by the pressure sensor Sp is equal to a predetermined pressure and also the difference between the detection temperature of the temperature sensor S1 and the detection temperature of the temperature sensor S2 (=superheat degree)is equal to a fixed value. The heat exchange expansion valve 28F is controlled so that the temperature sensor S5 at the exit of the heat exchange expansion valve 28F detects a predetermined value.

When the compressor 2 is driven under the above state, a part of the refrigerant discharged from the compressor 2 is led to the hot-water stocking heat exchanger 41 through the discharge pipe 7, the high-pressure pipe 11 and the switching valve 48. In the hot-water stocking heat exchanger 41, water passing through the water pipe 46 is heated to achieve hot water, and the hot water thus achieved is stocked in the hot-water stocking tank 43. Carbon dioxide refrigerant is used as the refrigerant, and the high-pressure supercritical cycle is established, so that the temperature of the hot-water thus stocked is equal to about 80° C. or more. The hot water stocked in the hot-water stocking tank 43 is fed to various facilities through pipes (not shown) (hot-water stocking operation).

The refrigerant after the heat exchange passes through the expansion valve 47 without being reduced in pressure through the expansion valve 47 which is controlled to be fully opened, and reaches the low-temperature high-pressure pipe 13. The refrigerant concerned is distributed to the indoor expansion valves 18*a*, 18*b* of the indoor units 5*a*, 5*b*, and reduced in pressure there. Further, the refrigerant is evaporated in the indoor heat exchangers 6*a*, 6*b*, and flows through the suction side valves 17*a*, 17*b*. Thereafter, the refrigerant is successively passed through the low-pressure pipe 12, the suction pipe 8 an the accumulator 4, and then sucked into the compressor 2.

On the other hand, the other part of the refrigerant discharged form the compressor 2 successively flows through the discharge pipe 7 and the change-over valves 9*a*, 19*a* to the outdoor heat exchangers 3*a*, 3*b*.

The refrigerant is heat-exchanged in the outdoor heat exchangers 3*a*, 3*b*, and then reaches the first inlet/outlet pipe 28C (functioning as an inlet pipe) of the heat exchange circuit 28 without being reduced in pressure in the outdoor expansion valves 27*a*, 27*b*.

The liquid refrigerant reaching the first inlet/outlet pipe 28C of the heat exchange circuit 28 is branched in the heat exchange circuit 28, and a part thereof flows to the branch pipe 28E while the other part of the refrigerant flows to the second heat exchanger portion 28H.

The liquid refrigerant flowing into the branch pipe 28E is reduced in pressure by the heat exchange expansion valve 28F and reaches the first the exchange portion 28G.

As a result, the heat exchange is carried out between the first heat exchange portion 28G and the second heat exchange portion 28H, and the first heat exchange portion 28G functions as an evaporator. The gas-liquid mixed refrigerant in the first heat exchange portion 28G becomes substantially gas-phase refrigerant, and it is supplied to the intermediate-pressure portion 2M of the compressor 2 through the gas outlet pipe 28B and compressed in the compressor 2.

The liquid-phase refrigerant flows through the second inlet/outlet pipe 28D to the low-temperature high-pressure pipe 13, and it is distributed to the indoor expansion valves 18*a*, 18*b* of the indoor units 5*a*, 5*b* and reduced in pressure.

Therefore, the refrigerant is evaporated in the indoor heat exchangers 6*a*, 6*b*, and flows through the suction side valves 17*a*, 17*b*. Thereafter, the refrigerant is successively passed through the low-pressure pipe 12, the suction pipe 8 and the accumulator 4, and then sucked into the compressor 2. As described above, all the indoor units 5*a*, 5*b* carry out the cooling operation at the same time by the action of the indoor heat exchangers 6*a*, 6*b* functioning as the evaporators.

Cooling+Hot-water Stocking Operation (part 2)

A second operation of the refrigerating machine under (cooling+hot-water stocking) operation will be described.

When the (cooling+hot-water stocking) operation is carried out, the change-over valves 9*a*, 19*a*, 9*b*, 19*b* of the outdoor heat exchangers 3*a*, 3*b* are closed. In addition, the discharge side valves 16*a*, 16*b* are closed, and the suction side valve 17*a*, 17*b* are opened. The outdoor fans 29*a*, 29*b* are set to the stop state, the indoor fans 23*a*, 23*b* are set to the driving state and the circulating pump 45 is set to the driving state. Furthermore, the switching valve 48 for connecting the high-pressure pipe 11 to the hot-water stocking heat exchanger 41 is opened.

When the compressor 2 is driven under the above state, the refrigerant discharged from the compressor 2 is led to the hot-water stocking heat exchanger 41 through the discharge pipe 7, the high-pressure pipe 11 and the switching valve 48. In the hot-water stocking heat exchanger 41, water passing through the water pipe 46 is heated, and the water whose temperature is increased is stocked in the hot-water stocking tank 43. Carbon dioxide refrigerant is used as the refrigerant, and a high-pressure supercritical cycle is established. Therefore, the hot water stocked in the tank 43 is increased to about 80° C. or more. The hot water stocked in the hot-water stocking tank 43 is fed to various facilities through pipes (not shown) (hot-water stocking operation).

The refrigerant after the heat exchange is passed through the fully-opened expansion valve 47 without being reduced in pressure, and reaches the low-temperature high-pressure pipe 13. Then, the refrigerant is distributed to the indoor expansion valves 18*a*, 18*b* of the indoor units 5*a*, 5*b* to be reduced in pressure again. Furthermore, the refrigerant is evaporated in the indoor heat exchangers 6*a*, 6*b*, and flows through the suction side valves 17*a*, 17*b*. Thereafter, the refrigerant is successively passed through the low-pressure pipe 12, the suction pipe 8 and the accumulator 4, and sucked into the compressor 2.

Hot-water Stocking Operation

Next, the operation of the refrigerating machine under the hot-water stocking operation will be described.

When the hot-water stocking operation is carried out, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* and the suction side valves 17*a*, 17*b* are closed. The outdoor fans 29*a*, 29*b* are set to the driving state, the indoor fans 23*a*, 23*b* are set to the stop state, and the circulating pump 45 is set to the driving state. Furthermore, the switching valve 45 for connecting the high-pressure pipe 11 to the hot-water stocking heat exchanger 41 is opened.

When the compressor 2 is driven under the above state, a part of the refrigerant discharged from the compressor 2 is led to the hot-water stocking heat exchanger 41 through the discharge pipe 7, the high-pressure pipe 11 and the switching valve 48. In the hot-water stocking heat exchanger 41, water passing through the water pipe 46 is heated, and the water which is increased to high temperature is stocked in the hot-water stocking tank 43. Carbon dioxide refrigerant is used as the refrigerant, and a high-pressure supercritical cycle is established. Therefore, the hot water stocked in the tank 43 is increased to about 80° C. or more. The hot water stocked in the hot-water stocking tank 43 is fed to various facilities through pipes (not shown) (hot-water stocking operation).

The refrigerant after the heat exchange is passed through the fully-opened expansion valve 47 without being reduced in pressure, and reaches the low-temperature high-pressure pipe 13. Then, the refrigerant reaches the second inlet/outlet pipe 28*d* (functioning as an inlet pipe) of the heat exchange circuit 28, flows into the second heat exchange portion 28H and a part thereof flows to the branch pipe 28E.

The liquid refrigerant flowing in the branch pipe 28E is reduced in pressure by the heat exchange expansion valve 28F and then reaches the first heat exchange portion 28G.

As a result, the heat exchange is carried out between the first heat exchange portion 28G and the second heat exchange portion 28H, and the first heat exchange portion 28G functions as an evaporator. The liquid-refrigerant in the first heat exchange portion 28G becomes substantially gas-phase refrigerant. The gas refrigerant thus achieved is supplied through the gas outlet pipe 28B to the intermediate-pressure portion 2M of the compressor 2, and compressed in the compressor 2.

Furthermore, the liquid-phase refrigerant flowing in the second heat exchange portion 28H is distributed to the indoor expansion valves 27*a*, 27*b* of the outdoor units 3*a*, 3*b* through the first inlet/outlet pipe 28C (functioning as a liquid outlet pipe), and reduced in pressure there.

Thereafter, the liquid refrigerant flows through the outdoor heat exchangers 3*a*, 3*b* to be evaporated, flows through the suction side valves 9*b*, 19*b*, and successively passes through the low-pressure pipe 12, the suction pipe 8 and the accumulator 4. Finally, the refrigerant is sucked into the compressor 2.

When the refrigerant when it enters the heat exchange circuit 28 is directly evaporated till its evaporating pressure, the ration between the gas-phase component and the liquid-phase component at the entrance of the evaporator corresponds to the ratio between L1 (gas-phase component) and L2 (liquid-phase component) in FIG. 4.

Accordingly, when the temperature of the refrigerant at the exit of the radiation side heat exchanger increases, the gas-phase component of the refrigerant entering the evaporation side heat exchanger is increased, and the performance of the evaporation side heat exchanger is lowered. On the other hand, when there is provided the heat exchange circuit 28, the ratio between the gas-phase component and the liquid-phase component of the refrigerant entering the evaporation side heat exchanger corresponds to the ratio between L1' (gas-phase) and L2' (liquid-phase), and the efficiency of the refrigerating cycle can be more enhanced by the amount corresponding the effect that the gas-phase component which does not contribute to cooling is not circulated in the low-pressure circuit subsequent to the low-temperature high-pressure pipe 13. Particularly, in this construction, carbon dioxide refrigerant is filled in the refrigerant circuit. Therefore, with respect to the ratio between the gas-phase component and the liquid-phase component which are separated in the heat exchange circuit 28, the amount of the gas-component is larger as compared with conventional Freon (chlorofluorocarbon) type refrigerant, and a larger amount of gas-phase component is introduced to the intermediate-pressure portion 2M of the compressor 2 to more enhance the efficiency.

As described above, when the cooling and heating mixed operation is carried out (one indoor unit carries out cooling operation and the other indoor unit carries out heating operation), or when the hot-water stocking operation is carried out, the refrigerant is circulated so that the indoor heat exchangers, the outdoor heat exchangers and the hot-water supplying heat exchanger are thermally balanced with one another. Accordingly, the refrigerating machine can be operated while indoor heat and outdoor heat can be efficiently used. Particularly in the case of the mixed operation of the cooling operation based on the indoor unit and the hot-water stocking operation, the hot water can be stocked (supplied) by indoor heat, and thus the heat can be remarkably effectively used, and occurrence of the heat island phenomenon caused by the heat of the outdoor unit can be suppressed to the minimum level.

[2] Second Embodiment

Figure 5:
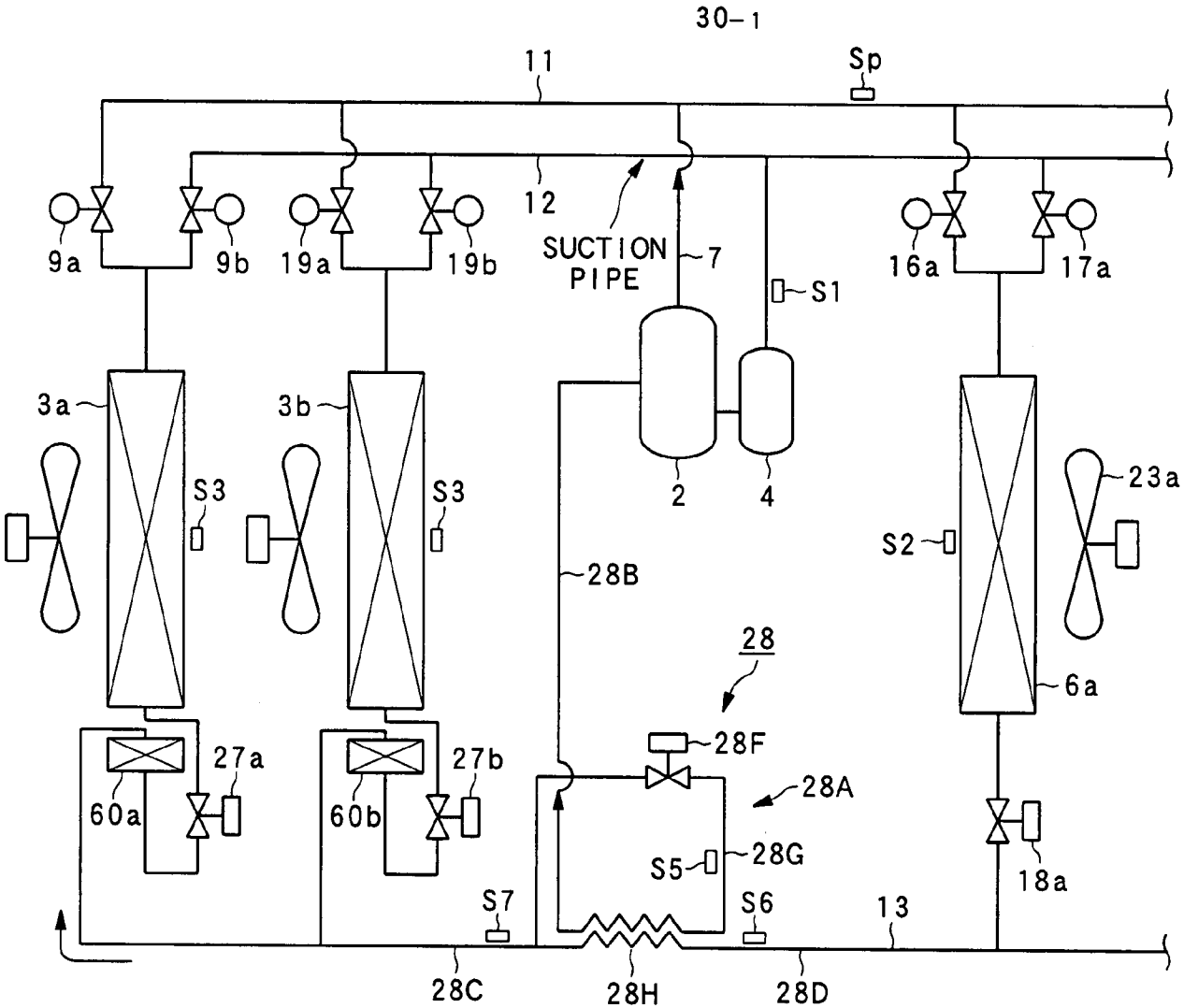
FIG. 5 is a diagram showing a refrigerant circuit of the main part of a refrigerating machine according to a second embodiment.

FIG. 5 is a refrigerant circuit diagram showing the main part of a refrigerating machine according to a second embodiment. In FIG. 5, the same parts as the first embodiment are represented by the same reference numerals.

The difference of a refrigerating machine 30-1 of the second embodiment from the refrigerating machine 30 of the first embodiment resides in that anti-freezing heat exchangers 60*a*, 60*b* for anti-freezing the liquid-phase refrigerant passing through the heat exchange circuit 28 under heating operation are provided integrally with the outdoor heat exchangers 3*a*, 3*b* serving as the heat source side heat exchangers respectively so as to be located between the outdoor expansion valve 27*a* and the heat exchange circuit 28*a* and between the outdoor expansion valve 27*b* and the heat exchange circuit 28, respectively.

Next, the operation of the refrigerating machine under heating operation will be described.

When the heating operation is carried out in the indoor units 5*a*, 5*b*, the change-over valves 9*a*, 19*a* of the outdoor heat exchangers 3*a*, 3*b* are closed and the other change-over valves 9*b*, 19*b* are opened. In addition, the discharge side valves 16*a*, 16*b* are opened and the suction side valves 17*a*, 17*b* are closed.

In this case, the indoor expansion valves 18*a*, 18*b* are fully opened so that the pressure of the refrigerant is not reduced, and the opening degrees of the outdoor expansion valves 27*a*, 27*b* are controlled so that the difference between the detection temperature of the temperature sensor S1 and the detection temperature of the temperature sensor S3 (corresponding to the superheat degree) and the high-pressure side pressure detected by the pressure sensor Sp are equal to predetermined values, and the heat exchange expansion valve 28F is controlled so that the temperature at the exit of the heat exchange expansion valve 27F which is detected by the temperature sensor S5 is equal to a predetermined value.

Accordingly, the refrigerant discharged from the compressor 2 is successively passed through the discharge pipe 7 and the high-pressure pipe 11, and then flows into the discharge side valves 16*a*, 16*b* and he indoor heat exchangers 6*a*, 6*b*. The refrigerant concerned is heat-exchanged without being condensed, and it is not reduced in pressure in the indoor expansion valves 18*a*, 18*b* under the full-opened state. Thereafter, the refrigerant reaches the second inlet/outlet pipe 28D (functioning as an inlet pipe) of the heat exchange circuit 28 through the low-temperature high-pressure pipe 13 and flows into the second heat exchange portion 28H. A part of the refrigerant also flows into the branch pipe 28E.

The gas-liquid mixed refrigerant flowing into the branch pipe 28E is reduced in pressure by he heat exchange expansion valve 28F, and reaches the first heat exchange portion 28G.

As a result, the heat exchange is carried out between the first heat exchange portion 28G and the second heat exchange portion 28H, and the first heat exchange portion 28G functions as an evaporator. The gas-liquid mixed refrigerant in the first exchange portion 28G becomes substantially gas-phase refrigerant, and it is supplied through the gas outlet pipe 28B to the intermediate-pressure portion 2M of the compressor 2 and compressed in the compressor 2.

The liquid-phase refrigerant flowing in the second heat exchange portion 28H is distributed through the first inlet/outlet pipe 28C (functioning as a liquid outlet pipe) to the anti-freezing heat exchangers 60*a*, 60*b*. The anti-freezing heat exchangers 60*a*, 60*b* carry out the heat exchange between the surrounding air and the refrigerant to radiate heat and thus heat the surrounding air, thereby additionally cooling the refrigerant.

As a result, the refrigerant thus additionally cooled reaches the indoor expansion valves 27*a* ,27*b* of the outdoor units 3*a*, 3*b* to be reduced in pressure. Thereafter, the liquid-phase refrigerant is evaporated in the outdoor heat exchangers 3*a*, 3*b*, and flows to the suction side valves 9*b*, 19*b*. Thereafter, the refrigerant is successively passed through the low-pressure pipe 12, the suction pipe 8 and the accumulator 4, and sucked into the compressor 2.

As described above, according to the second embodiment, the freezing of the refrigerant can be prevented in the outdoor heat exchangers 3*a*, 3*b* serving as the heat source side heat exchangers under heating operation.

The heat exchange circuit of the present invention is not limited to the above embodiment, and the following modifications may be made.

Figure 6:
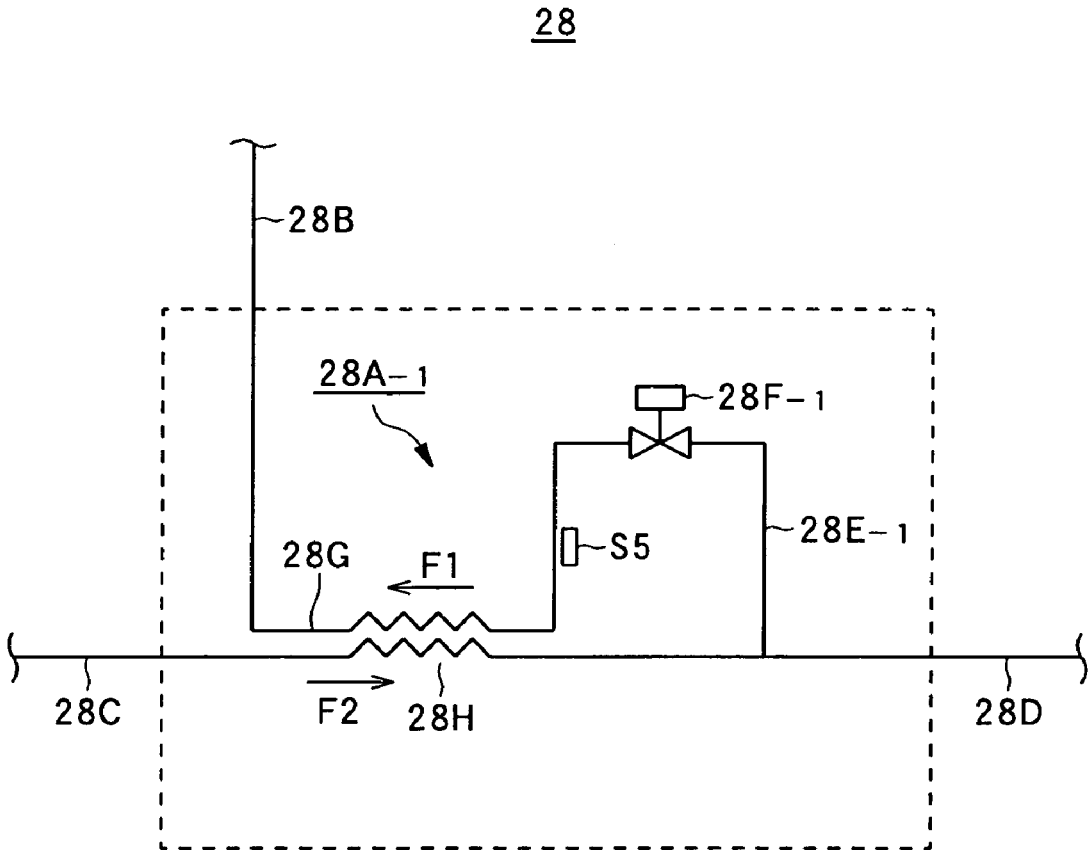
FIG. 6 is a diagram showing the construction of a heat exchange circuit of another embodiment.

FIG. 6 is a diagram showing the construction of a modification of the heat exchange circuit according to the present invention. In FIG. 6, the same parts as the heat exchange circuit of FIG. 3 are represented by the same reference numerals.

A heat exchange circuit 28-1 of this modification mainly comprises a heat exchange portion 28A-1, a gas outlet pipe 28B, a first inlet/outlet pipe 28*c* and a second inlet/outlet pipe 28D.

The heat exchange portion 28A-1 is equipped with a branch pipe 28E-1 branched from the second inlet/outlet pipe 28D, a heat exchange expansion valve 28F-1 connected to the branch pipe 28E-1, a first heat exchange portion 28G that is connected to the heat exchange expansion valve 28F-1 at one end thereof and also intercommunicates with the gas outlet pipe 28B at the other end thereof to carry out actual heat exchange, and a second heat exchange portion 28H that is branched from the second inlet/outlet pipe 28D and intercommunicates with the first inlet/outlet pipe 28C to carry out heat exchange with the firs heat exchange portion 28G.

In this case, the pipes constituting the first heat exchange portion 28G and the second heat exchange portion 28H are arranged so that the flow Fl of the refrigerant in the first heat exchange portion 28G and the flow F2 of the refrigerant in the second heat exchange portion 28H are opposite to each other, that is, they counter-flow in the opposite directions as shown in FIG. 6.

The operation and effect of this modification are the same as the heat exchange circuit of FIG. 3, and thus the detailed description thereof is omitted.

In the foregoing description, the flow direction of the refrigerant in the heat exchange circuit forms the counter-flow under cooling operation. However, when more attention is paid to the heating operation, the pipes may be arranged so that the counter-flow is established under heating operation.

In the foregoing description, the expansion valve at the evaporation side heat exchanger side is controlled so that the temperature difference between the detection temperature of the temperature sensor disposed at the center portion of the heat exchanger used as an evaporator and the detection temperature of the temperature sensor disposed at the exit portion of the heat exchanger (so-called superheat degree) is equal to a fixed value and the high-pressure side pressure detected by the pressure sensor Sp disposed at the high-pressure pipe 11 is equal to a predetermined value, and the expansion valve of the heat exchange circuit is controlled so that the intermediate-pressure temperature is equal to a predetermined value. The predetermined values of the high-pressure side pressure and the intermediate-pressure portion temperature are calculated from the temperature at the exit of the heat exchanger used as the radiation side heat exchanger (for example, the temperature detected by the temperature sensor S6 or temperature sensor S7) and the temperature of the heat exchanger functioning as the evaporation side heat exchanger (for example, the temperature detected by the temperature sensor S2 or the temperature sensor S3). The predetermined values are preset so that the cycle efficiency is optimal, and the compressor is subjected to capacitance control (rotational number control) in accordance with the load. However, another value which enables the same control may be used as the control amount as described below.

(1) The intermediate-pressure temperature may be substituted by the intermediate-pressure portion pressure, the temperature of the liquid refrigerant at the exit of the heat exchange circuit.

(2) The evaporator temperature may be substituted by the evaporator pressure, the outside air temperature or the indoor temperature.

(3) The temperature at the exit of the radiation side heat exchanger may be substituted by the outside air temperature, the indoor temperature or the supply water temperature.

(4) The pressure at the high-pressure side may be substituted by the discharge temperature.

In the foregoing description, the hot-water stocking unit is used as a thermal storage unit. However, a cold water (ice) thermal storage unit may be considered as a thermal storage unit using water as a thermal storage medium. In this case, the cold water (ice) thermal storage unit may be used in place of the hot-water stocking unit or in addition to the hot-water stocking unit, or it is also used as a hot-water stocking unit.

In this case, when the cold water (ice) thermal storage unit is used in place of the hot-water stocking unit, the switching valve 48 connected to the high-pressure pipe 11 may be connected to the low-pressure pipe 12. Furthermore, when the cold water (ice) thermal storage unit is used in addition to the hot-water stocking unit, it may be designed in the same construction as the hot-water stocking unit, and the switching valve may be connected to the low-pressure pipe 12. Still furthermore, when the cold water (ice) thermal storage unit is also used as a hot-water stocking unit, a second switching valve which is exclusively kept to be opened to the switching valve 48 may be provided so as to be connected to the low-pressure pipe 12.

What is claimed is

1. A refrigerating machine comprising:

an outdoor unit containing a compressor and an outdoor heat exchanger serving as a heat- source side heat exchanger; and a plurality of indoor units, wherein:

each of the plurality of indoor units contains an indoor heat exchanger as a using side heat exchanger and is connected to the outdoor unit through an inter-unit pipe;

one end of the outdoor heat exchanger is connected to both a refrigerant discharge pipe and a refrigerant suction pipe of the compressor, wherein the outdoor heat exchanger connection is selectively controlled by a first valve to provide a connection between the outdoor heat exchanger and to either the refrigerant discharge pipe or the refrigerant suction pipe of the compressor;

the inter-unit pipe comprising: a high-pressure pipe, a low pressure pipe and a low-temperature high-pressure pipe, wherein:

the high-pressure pipe is connected to the refrigerant discharge pipe, the low-pressure pipe is connected to the refrigerant suction pipe and the low-temperature high-pressure pipe is connected to the other end of the outdoor heat exchanger, one end of the indoor heat exchanger of each of the indoor units is connected to both the high-pressure pipe and the low-pressure pipe, wherein the one end of the indoor heat exchanger is selectively controlled by a second valve to provide a connection between the one end of the indoor heat exchanger and to either the high-pressure pipe or the low-pressure pipe;

the other end of the indoor heat exchanger of each of the indoor units is connected to the low-temperature high-pressure pipe, the plural indoor units carry out either a cooling operation or a heating operation or carry out both the cooling operation and the heating operation in a mixing style at the same time;

the compressor has an intermediate-pressure portion in which refrigerant having intermediate pressure higher than the pressure of the refrigerant at the suction side of the compressor and lower than the pressure of the refrigerant at the discharge side of the compressor is allowed to be introduced; and the refrigerating machine is further provided with a heat exchange circuit formed in the low-temperature high-pressure pipe between the heat-source side heat exchanger and the using side heat exchanger, wherein the heat exchange circuit:

branches the refrigerant flowing from any one of the heat source-side heat exchanger and the using side heat exchanger, carries out heat exchange between a first branched refrigerant after the branching and any of the other branched refrigerant positioned after the branching and the refrigerant positioned before the branching so that the first branched refrigerant is set to a gas-phase refrigerant, and leads the gas-phase refrigerant thus achieved to any of the intermediate-pressure portion and the refrigerant suction pipe of the compressor.

2. The refrigerating machine according to claim 1, wherein the heat exchange circuit is provided with a pressure reducing device for expanding the first branched refrigerant before the first branched refrigerant is heat-exchanged.

3. The refrigerating machine according to claim 2, wherein the pressure reducing device has an expansion valve, and the opening degree of the expansion valve is adjusted on the basis of any one of the temperature at the exit of the expansion valve and the temperature at the exit of the other branched refrigerant side after the branching in the heat exchange circuit.

4. The refrigerating machine according to claim 1, wherein the heat exchange circuit has two refrigerant pipe systems, the first branched refrigerant flowing through one of the two refrigerant pipe systems while the other branched refrigerant flows through the other refrigerant pipe system, and the refrigerant pipe systems are arranged so that the first branched refrigerant and the other branched refrigerant counter-flow in the opposite direction.

5. The refrigerating machine according to claim 4, wherein the refrigerant pipe systems are arranged so that the one branched refrigerant and the other branched refrigerant counter-flow in the opposite direction at least under cooling operation.

6. The refrigerating machine according to claim 1, wherein the inside of the high-pressure pipe connected to the refrigerant discharge pipe is driven under supercritical pressure while the refrigerating machine is operated.

7. The refrigerating machine according to claim 6, wherein carbon dioxide refrigerant is filled as the refrigerant in a refrigerant pipe.

* * * * *

UNITED STATES PATENT AND TRADEMARK OFFICE

CERTIFICATE OF CORRECTION

PATENT NO. : 7,533,539 B2
APPLICATION NO. : 11/151297
DATED : May 19, 2009
INVENTOR(S) : Masahisa Otake et al.

It is certified that error appears in the above-identified patent and that said Letters Patent is hereby corrected as shown below:

On the title page, Item "(73) Assignees", after "Sanyo Electric Co., Ltd., Osaka (JP), change the second Assignee name from "Sanyo Air-Conditioning Corporation" to --Sanyo Air-Conditioners Corporation, Gunma (JP)--.

Signed and Sealed this

Fourth Day of August, 2009

JOHN DOLL
*Acting Director of the United States Patent and Trademark Office*